US007650000B2

(12) United States Patent
Kawana et al.

(10) Patent No.: US 7,650,000 B2
(45) Date of Patent: Jan. 19, 2010

(54) AUDIO DEVICE AND PLAYBACK PROGRAM FOR THE SAME

(75) Inventors: Kazuhiro Kawana, Kashiwa (JP); Toshio Saito, Urayasu (JP); Hareo Hamada, Musashino (JP); Noriyuki Hanawa, Foster City, CA (US)

(73) Assignee: Dimagic Co., Ltd., Tokyo (JP)

( * ) Notice: Subject to any disclaimer, the term of this patent is extended or adjusted under 35 U.S.C. 154(b) by 706 days.

(21) Appl. No.: 10/514,277

(22) PCT Filed: Sep. 10, 2002

(86) PCT No.: PCT/JP02/09205

§ 371 (c)(1),
(2), (4) Date: Jul. 11, 2005

(87) PCT Pub. No.: WO03/096746

PCT Pub. Date: Nov. 20, 2003

(65) Prior Publication Data

US 2006/0013101 A1 Jan. 19, 2006

(30) Foreign Application Priority Data

May 13, 2002 (JP) ..... 2002-136917

(51) Int. Cl.
*H04R 5/00* (2006.01)

(52) U.S. Cl. ..... 381/17; 381/1; 381/18; 381/310

(58) Field of Classification Search ..... 381/1, 381/17–18, 61, 307, 310, 71.11–71.12, 300
See application file for complete search history.

(56) References Cited

U.S. PATENT DOCUMENTS

| | | | | |
|---|---|---|---|---|
| 5,434,948 | A * | 7/1995 | Holt et al. | 704/220 |
| 5,528,694 | A * | 6/1996 | Van De Kerkhof et al. | 381/27 |
| 6,553,121 | B1 * | 4/2003 | Matsuo et al. | 381/17 |
| 6,683,959 | B1 * | 1/2004 | Kuwano et al. | 381/17 |
| 6,778,601 | B2 * | 8/2004 | Ise et al. | 375/232 |
| 6,956,954 | B1 * | 10/2005 | Takemura et al. | 381/307 |
| 7,079,660 | B2 * | 7/2006 | Ohama et al. | 381/98 |
| 7,242,782 | B1 * | 7/2007 | Kasai et al. | 381/97 |
| 2003/0123674 | A1 * | 7/2003 | Boland | 381/66 |

* cited by examiner

*Primary Examiner*—Vivian Chin
*Assistant Examiner*—Disler Paul

(57) ABSTRACT

The input signal X of one channel is divided by a multi-stage delay processing device $Z^{-1}$ and each of the outputs is superimposed by a specified coefficient by a coefficient processing device $W_0, W_1, \ldots, W_k$. The results are added by an adder, thereby providing a correlation eliminating filter for extracting a signal component from the input signal X of one channel having a high correlation with the input signal Y of the other channel. There is provided a coefficient updating processing device 5 for successively changing the feature of the correlation eliminating filter according to an error signal e obtained from the output signal RES and the input signal Y from the other channel, and the input signal X of one channel. A surround signal is obtained from a difference between the output RES from the correlation eliminating filter and the input signal Y of the other channel. Thus, upon reproduction of a two channels stereo signal, it is possible to generate a surround signal not giving uncomfortable feeling to a listener.

8 Claims, 9 Drawing Sheets

AUDIO DEVICE AND PLAYBACK PROGRAM FOR THE SAME

TECHNICAL FIELD

The present invention relates to an audio device that produces a multi-channel audio signal from a two-channel stereo audio signal, and a playback program for the same.

BACKGROUND ART

There has long been a demand for the production of multi-channel audio signals from two-channel stereo audio signals, and numerous audio devices have such a function. However, it is known that such devices involve a feeling of reversed phase and a feeling of disharmony during playback.

In the conventional production of multi-channel signals from two-channel signals, especially signals known as "surround" or the like that are played back from the area extending from the sides to the rear of the listener, or signal OSL and OSR, which are signals that are not localized in the area extending from the sides to the rear of the listener, [a method in which] the difference between the input stereo audio signals INL and INR is calculated as shown in FIG. 1 an the following "Equation 1" is calculated and played back is generally used.

$$OSL=INL-INR$$

$$OSR=INR-INL \qquad \text{Equation (1)}$$

In this case, since OSL and OSR are mutually reversed phases, it is quite natural that the listener experiences a feeling of reversed phase during playback. Specifically, FIGS. 8 and 9 show examples of the waveforms and frequency characteristics of the stereo audio signals INL and INR that constitute the input signals. Surround signals such as those shown in FIGS. 10 and 11 are produced by subjecting such stereo audio signals INL and INR to the processing shown in FIG. 1.

As is clear from this FIG. 10, if surround signals are merely produced from the difference between the left and right stereo audio signals, the left and right surround signals OSL and OSR have reversed phases. Furthermore, as is shown in FIG. 10, the left and right signals have the same amplitude but reversed phases; accordingly, the correlation is strong, and since the signals are completely different from the stereo audio signals that are the production source, the feeling of disharmony during playback is not eliminated.

Furthermore, as is shown by the frequency characteristics in FIG. 9, the left and right input signals both have common signal components in the vicinity of 4.5 kHz, and these components are a cause of the feeling of disharmony. In the surround signals produced from the difference between such input signals, the left and right signals are constructed from the same frequency components as shown in FIG. 11, so that the correlation of both signals is extremely strong, and there is a strong unnatural impression.

Accordingly, there have been proposals to reduce the correlation between surround signals, and thus eliminate the reverse phase feeling and feeling of disharmony experienced by the listener. However, conventional techniques of this type of not go beyond simple phase manipulation, amplitude manipulation and the like; there have been no proposals of essential correlation elimination processing in the production of surround signals.

Furthermore, in quasi-stereo processing and the like, there have been widely used correlation elimination methods, e.g., correlation elimination processing using comb filters or the like. However, since such phase elimination processing is performed on signals obtained by "Equation 1", i.e., signals that have the same amplitude by reversed phases, the elimination of a reversed phase feeling and a feeling of disharmony has not yet been achieved.

The present invention was devised in order to solve the problems encountered in the prior art; it is an object of the present invention to provide an audio device that eliminates a reversed phase feeling and feeling of disharmony by performing correlation elimination processing that introduces an adaptive signal processing technique for the production of surround signals.

DISCLOSURE OF THE INVENTION

In the present invention, as is shown in FIG. 2, surround signals are produced using an adaptive correlation elimination device that introduces an adaptive signal processing technique. In this adaptive correlation elimination device 1, signals X and Y are input, and a signal O is output. A signal in which signal components having a high correlation with Y among the signal components of X are extracted is subtracted and output. This system is constructed from an adaptive filter or the like which performs a tracking action by constantly varying its own filter characteristics so that signal components among the X signal components that have a high correlation with Y signal components are extracted and output. By subtracting the output of the adaptive filter from the Y [signal], it is possible to suppress signal components that have a high correlation with each other, and thus to eliminate the feeling of reversed phase and the feeling of disharmony experienced by the listener, without separating the process that produces the surround signals and the process of the correlation elimination processing.

Specifically, the audio device of the present invention is an audio device which produces surround signals of a plurality of channels on the basis of audio signals of two channels constituting input signals, characterized in that this audio device is provided with a correlation eliminating filter whereby the input signal of one channel is divided by a multi-stage delay processing device, a specified coefficient is superimposed by a coefficient processing device for each of the divided multi-stage outputs so that multi-stage output components are produced, and signal components that have a high correlation with the input signal of the other channel are extracted from the input signal components of the first channel by adding these multi-stage output components, and an adaptive correlation eliminating device comprising a coefficient updating processing device which constantly varies the characteristics of this correlation eliminating filter on the basis of error signals obtained by means of these output signals and the input signals from the abovementioned other channel, as well as the input signals from the abovementioned first channel, and the difference between the output from this correlation eliminating filter and the input signals from the other channel is calculated and output as a surround signal.

Preferably, the abovementioned correlation eliminating filter is constructed from an FIR filter. Furthermore, the abovementioned coefficient updating processing device is characterized in that this device performs updating of the coefficients on the basis of an LMS algorithm, or performs updating of the coefficients on the basis of an NLMS algorithm.

Preferably, the abovementioned correlation eliminating filter is constructed from an IIR filter. The abovementioned coefficient updating processing device performs updating of the coefficients on the basis of an SHARF algorithm.

The audio playback program of the present invention is an audio playback program for producing surround signals of a plurality of channels on the basis of audio signals of two channels constituting input signals, characterized in that this program comprises a step in which the input signal of one channel is divided by a multi-stage delay processing step, and a specified coefficient is superimposed for each of the divided multi-stage outputs, a correlation elimination step in which signal components that have a high correlation with the input signal of the other channel are extracted from the input signal components of the first channel, and a coefficient updating processing step in which the characteristics of the abovementioned coefficients in this correlation elimination step are constantly varied on the basis of error signals obtained by these output signals from the correlation elimination step and the input signals from the abovementioned other channel, as well as of the input signals from the abovementioned first channel, and a step in which the difference between the output from this correlation elimination step and the input signals from the other channel is calculated, and is output as a surround signal.

In the present invention constructed as described above, an adaptive filter that successively varies the coefficients that are superimposed on the input signals in accordance with the input and output signals is used as a correlation eliminating filter that forms an adaptive correlation eliminating device. As a result, the correlation between the input signals of the two channels can be greatly lowered, so that the feeling of reversed phase and feeling of disharmony that have been major problems in the production of multi-channel audio signals from stereo audio signals of two channels can be eliminated.

BEST MODE FOR CARRYING OUT THE INVENTION

Embodiments of the present invention will be described below in concrete terms with reference to the attached figures. Furthermore, the present invention can be applied to all audio devices that produce surround signals from stereo signals of two channels, regardless of the number of channels produced. However, devices producing four-channel, five-channel and 5.1-channel signals will be described below. Furthermore, the filters and coefficient updating algorithms used in the description indicate examples of the present invention; the present invention is not limited to these filters and algorithms. Moreover, the signals that are produced are output "as is" or after being subjected to acoustic effects and signal processing such as reverberation effects, delay processing, down sampling or the like. However, the embodiments merely indicate examples; the present invention is not limited to these effects and processing.

Production of Four-Channel Signals

Figure 1:
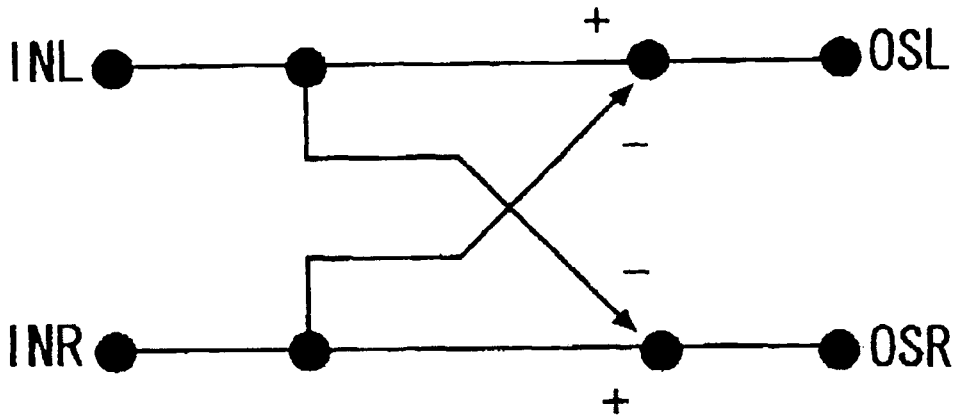
FIG. 1 is a block diagram which shows the method used to produce surround signals in a conventional audio device.
Figure 2:
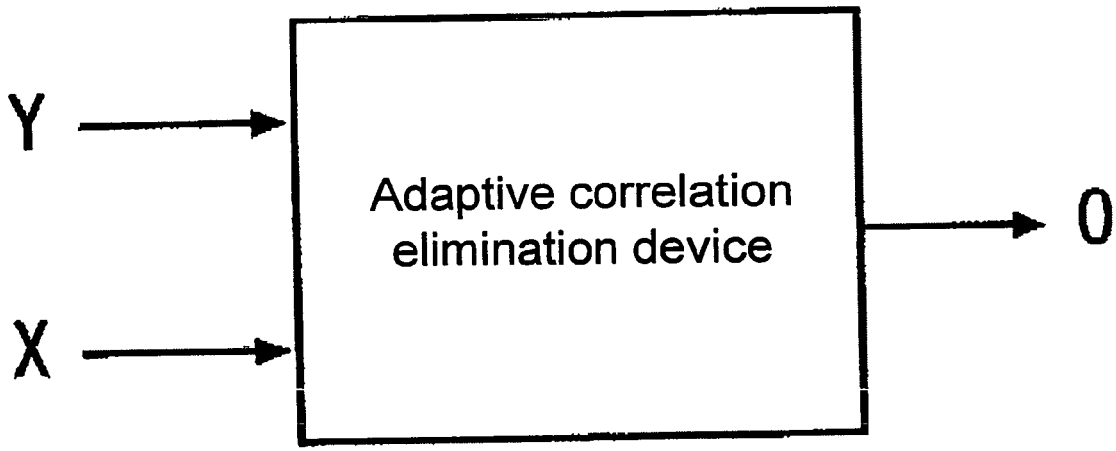
FIG. 2 is a block diagram which shows the method used to produce surround signals using an adaptive correlation eliminating device in the present invention.
Figure 3:
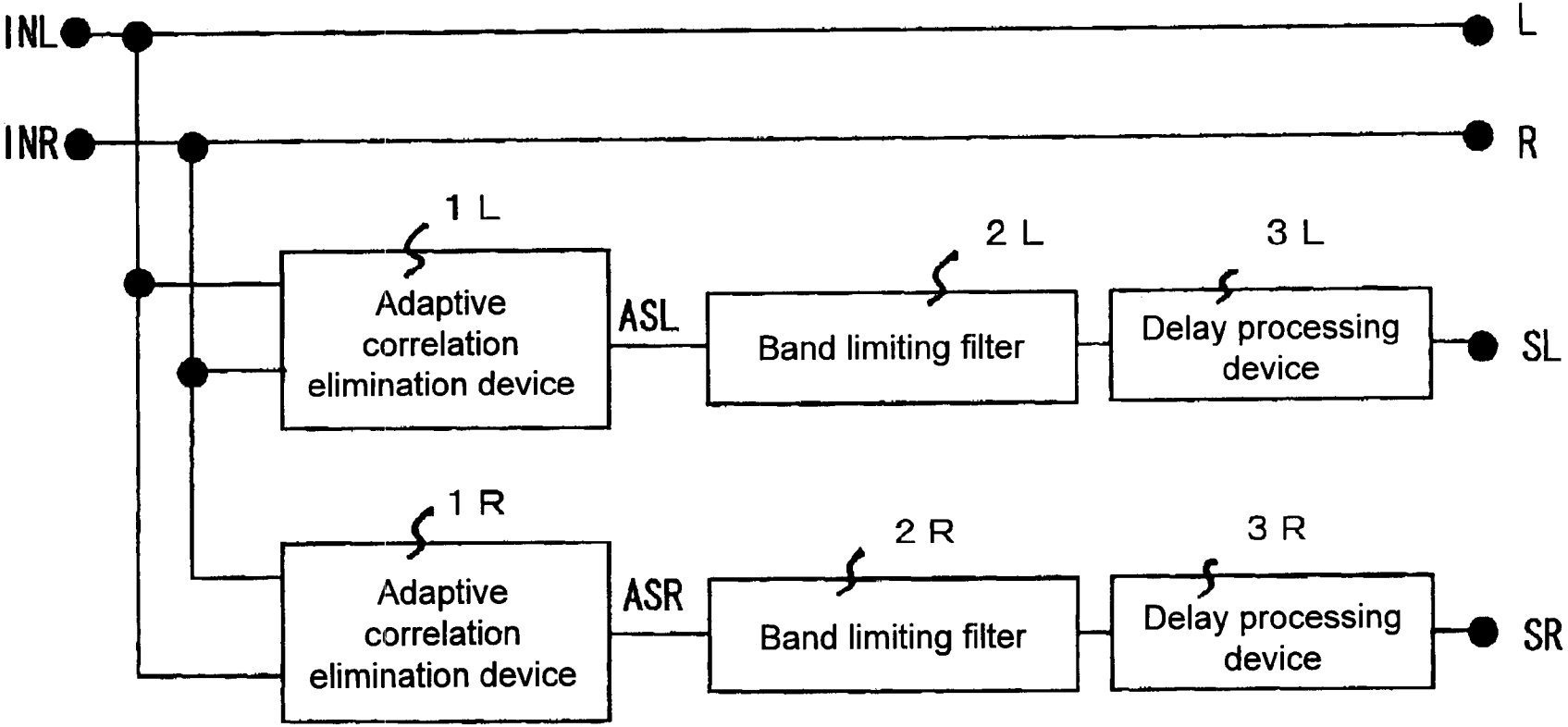
FIG. 3 is a block diagram which shows an embodiment in which the present invention is used to produce four-channel signals.

An embodiment in which four-channel signals are produced from stereo signals of two channels will be described with reference to FIG. 3.

In the present embodiment, INL and INR, which are stereo audio signals of two channels, are input. The four-channel signals L, R, SL and SR that are output are produced from the input signals INL and INR that are input. L is a signal that is localized on the left front of the listener, or that is played back from the left front of the listener. R is a signal that is localized on the right front of the listener, or that is played back from the right front of the listener. SL is a signal that is localized extending from the left side to the left rear of the listener, or that is played back from the let side to the left rear of the listener. SR is a signal that is localized extending from the right side to the right rear of the listener, or that is played back from the right side to the right rear of the listener.

Among the four-channel signals that are output, L and R are signals that output INL and INR "as is". In the case of SL, INR is input into the input X of the adaptive correlation eliminating device 1L, INL is input into the input Y, and a signal constituting ASL is produced from the adaptive correlation eliminating device 1L. This signal ASL is subjected to band limitation and delay processing by being passed through a band limiting filter 2L and delay processing device 3L, and is then output as a left side surround signal. On the other hand, in the case of SR, INL is input into the input X of the adaptive correlation eliminating device 1R, INR is input into the input Y, and a signal constituting ASR is produced from the adaptive correlation eliminating device 1R. This signal ASR is subjected to band limitation and delay processing by being passed through a band limiting filter 2R and delay processing device 3R, and is then output as a right side surround signal.

Thus, in the present embodiment, left and right surround signals are obtained by processing stereo signals of two channels by means of adaptive correlation eliminating devices 1L and 1R, thus producing four-channel signals from stereo signals of two channels.

Production of Five-Channel Signals

Figure 4:
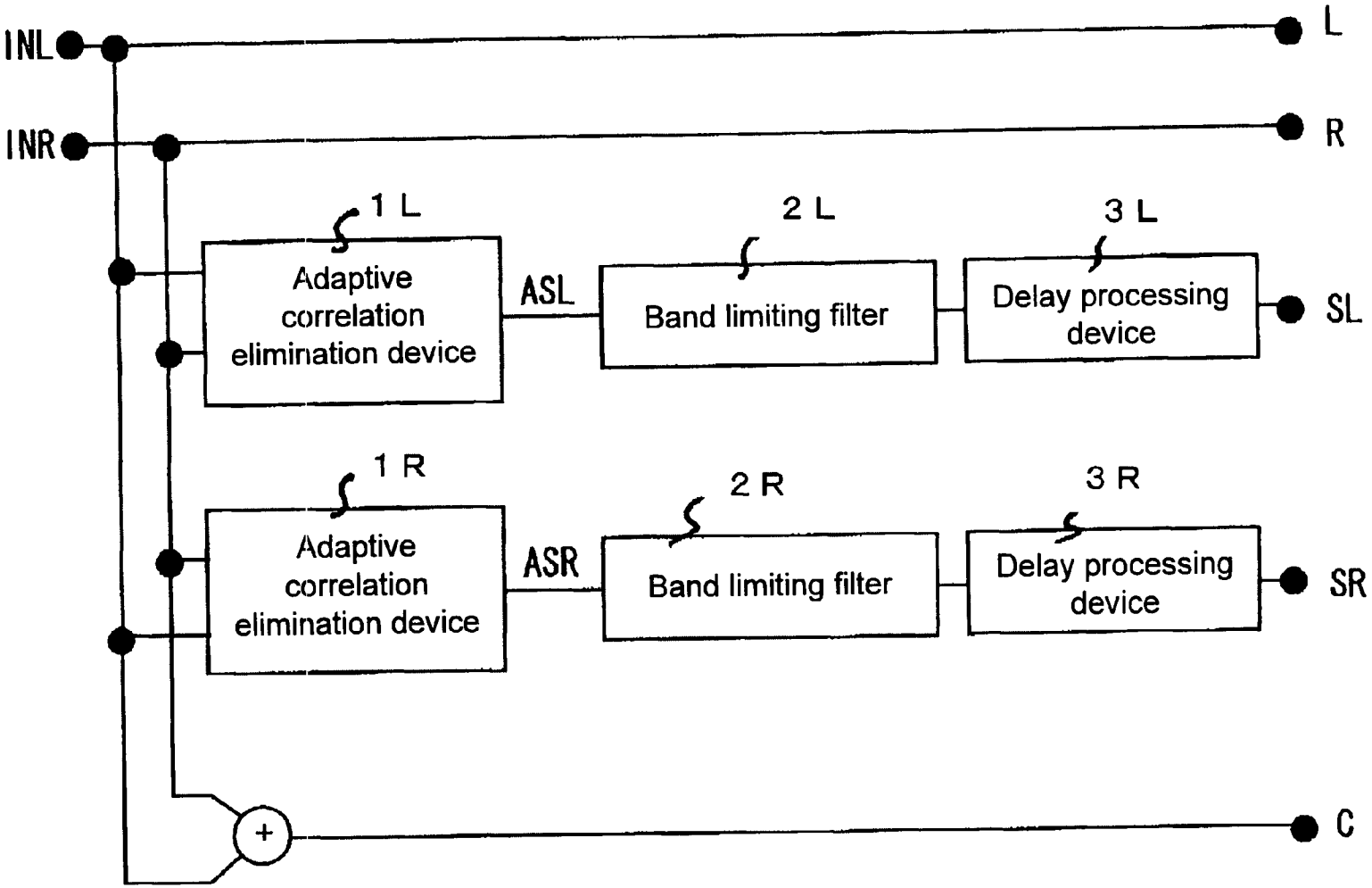
FIG. 4 is a block diagram which shows an embodiment in which the present invention is used to produce five-channel signals.

An embodiment in which five-channel signals are produced from stereo signals of two channels will be described with reference to FIG. 4.

INL and INR, which are stereo audio signals of two channels, are input. The five-channel signals L, R, SL, SR and C that are output are produced from the input signals INL and INR. Among these, the signals L, R, SL and SR are produced in the same manner as the four signals L, R, SL and SR of the four-channel signals shown in the abovementioned FIG. 3.

In the case of the signal C that is localized directly in front of the listener, or that is played back from in front of the listener, a component that is the sum of the input signals INL and INR is output. As a result of such processing, five-channel signals are produced from the stereo signals of two channels.

Production of 5.1-Channel Signals

Figure 5:
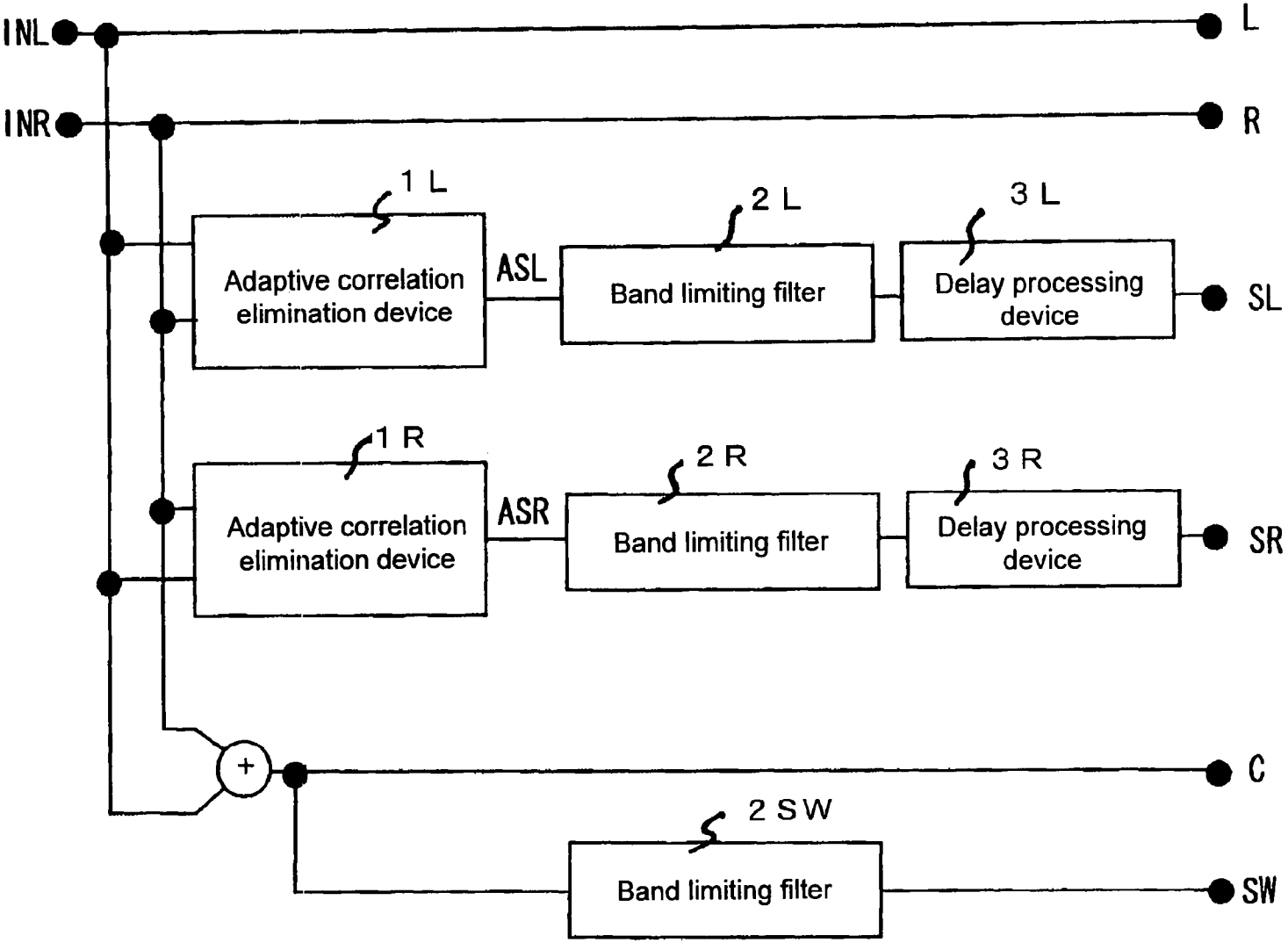
FIG. 5 is a block diagram which shows an embodiment in which the present invention is used to produce 5.1-channel signals.

An embodiment in which 5.1-channel signals are produced from stereo signals of two channels will be described with reference to FIG. 5.

INL and INR, which are stereo audio signals of two channels, are input. The 5.1-channel signals L, R, SL, SR, C and SW (a signal that is played back from a bass region voice speaker) that are output are produced from the input signals INL and INR. Among these, the signals L, R, SL, SR and C are produced in the same manner as the five signals L, R, SL, SR and C of the five-channel signals shown in the abovementioned FIG. 4.

The signal SW that is played back from the bass region voice speaker is output by subjecting a component that is the sum of the input signals INL and INR to band-limiting processing by means of a band-limiting filter 2SW. As a result of such processing, 5.1-channel signals are produced from stereo signals of two channels.

Examples of Construction of Adaptive Correlation Eliminating Device

Next, examples of the construction of the adaptive correlation eliminating devices 2L and 2R used in the respective embodiments described above will be described. Furthermore, in the respective correlation eliminating devices 2L and 2R, the input signals X and Y correspond to the stereo signals INL and INR of two channels. However, the correspondence between the input signals X and Y and the stereo signals INL and INR may be switched in accordance with the surround signals SL and SR of the left and right channels that constitute the output signals.

Furthermore, adaptive signal processing includes many types of processing that do not rely on filter constructions such as FIR (finite impulse response) filters, IIR (infinite impulse response) filters or the like. Specifically, in the present invention, the filter construction and updating algorithm of the adaptive signal processing can be appropriately selected with consideration given to hardware and software limitations and conditions; the present invention is not limited to the filter constructions and updating algorithms cited below.

Adaptive Signal Processing Using FIR Filter

Figure 6:
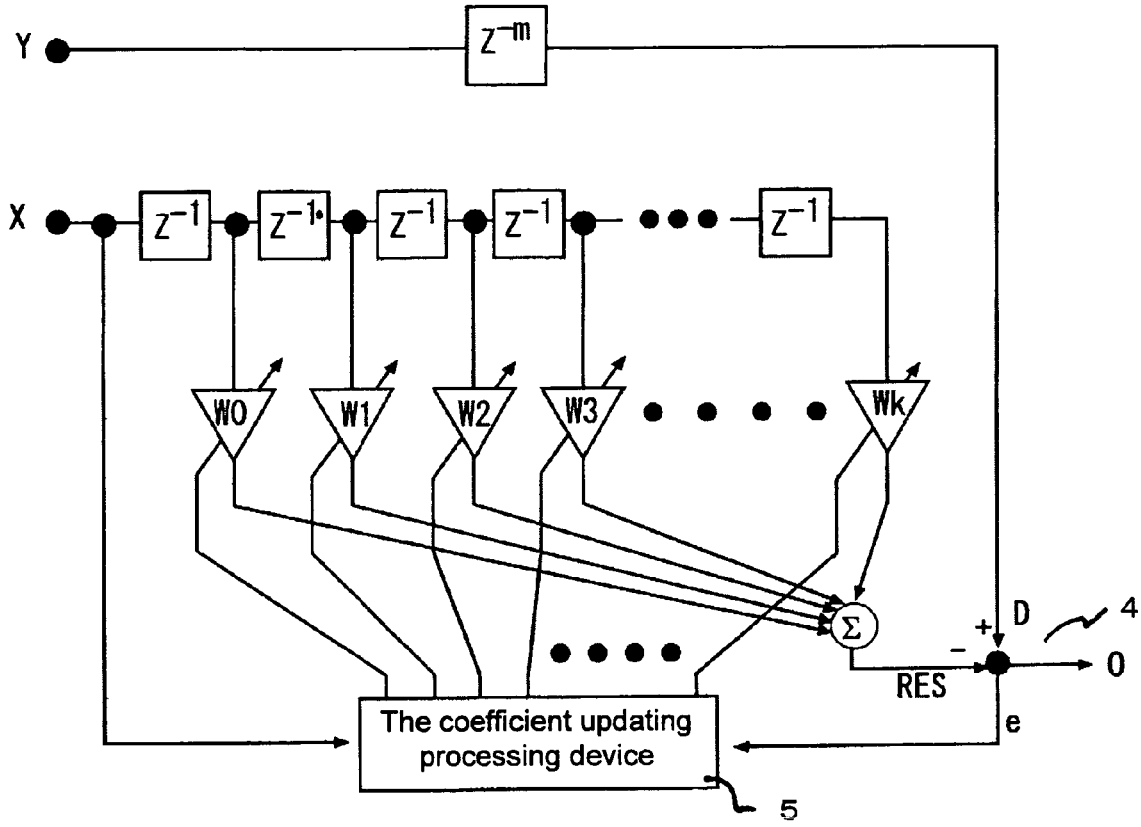
FIG. 6 is a block diagram showing an example of construction of the adaptive correlation eliminating device using an FIR filter.

An example of the construction of an adaptive correlation eliminating device using adaptive signal processing based on an FIR filter is shown in FIG. 6. This adaptive correlation eliminating device comprises input terminals for an addition side input signal Y and a subtraction side input signal X, and an output terminal for an output signal O constituting a surround signal. The addition side input signal Y is input into an operator 4 via a delay processing device $Z^{-m}$.

Meanwhile, the subtraction side input signal X is successively subjected to delay processing by means of delay processing devices $Z^{-1}$ installed in multiple stages constituting the FIR filter, and is then superimposed with a specified coefficient by a coefficient processing device W comprising $W_0$, $W_1$, . . . , $W_k$ as elements as shown in the following "Equation 2". Subsequently, the output components of the multiple stages are added by an adder Σ, thus producing a response signal RES. Here, k is the tap length (number of the delay processing).

$$RES(n)=X(n)^T W(n) \quad \text{Equation (2)}$$

The response signal RES thus obtained is input into the operator 4, and this response signal RES is subtracted from the input signal Y of the other channel that is likewise input into the operator 4, thus producing an error signal e and an output signal O. This operation is as shown in the following "Equation 3" through "Equation 6". Here, g is an arbitrary constant.

$$D(n)=Y(n)^T Z \quad \text{Equation (3)}$$

$$Z=[000 \ldots g \ldots 00] \quad \text{Equation (4)}$$

$$O(n)=D(n)-RES(n) \quad \text{Equation (5)}$$

$$E(n)=O(n) \quad \text{Equation (6)}$$

Adaptive Algorithms

In the present embodiment, the abovementioned coefficient processing devices W are updated by means of a coefficient updating processing device 5 comprising an adaptive algorithm so that components that show a high correlation with components of the input signal Y among the components of the input signal X are extracted. Specifically, the input signal X and an error signal e from the operator 4 are constantly input into this coefficient updating processing device 5, and this input signal X and error signal e are processed by the updating algorithm so that coefficient updating commands are output to the coefficient processing devices $W_0$, $W_1$, $W_k$ from the coefficient updating processing device 5, and the values of the coefficients that are superimposed on the output signals of the delay processing devices $Z^{-1}$ of the respective stages vary on the basis of these commands.

Various updating systems may be used in such a coefficient updating processing device 5. The LMS (least mean square) algorithm and the NLMS (normalized least mean square) algorithm will be described as typical algorithms for purposes of description.

LMS Algorithm

The LMS algorithm is an algorithm that uses the instantaneous square error as an evaluation quantity; in this case, the coefficient processing devices W are updated by means of the following "Equation 7". Here, μ is the step size parameter, and is a quantity that greatly affects the performance of the adaptive correlation eliminating device that is realized.

$$W(n+1)=W(n)+2\mu \cdot e(n) \cdot X(n) \quad \text{Equation (7)}$$

NLMS Algorithm

The NLMS algorithm has a response speed that is superior to that of the LMS algorithm, and is therefore widely used. In this algorithm, the amount of updating is normalized by the power of the input from past to present. This NLMS algorithm updates the coefficient processing devices by means of the following "Equation 8" through "Equation 10"; here, α is a forgetting coefficient, and determines the weighting with respect to past input.

$$W(n+1)=W(n)+2\mu \cdot u(n) \cdot e(n) \cdot X(n) \quad \text{Equation (8)}$$

$$u(n)=2/(j+1)\hat{\sigma}(n)^2 \quad \text{Equation (9)}$$

$$\hat{\sigma}(n)^2=\alpha \cdot X(n)^2+(1-\alpha) \cdot \hat{\sigma}(n-1)^2 \quad \text{Equation (10)}$$

The coefficient processing devices W are updated by means of a coefficient updating processing device 5 comprising such an adaptive algorithm, and adaptive correlation eliminating processing is accomplished by repeating the operation of processing the input X by means of the updated coefficient processing devices W.

Adaptive Signal Processing Using IIR Filter

Figure 7:
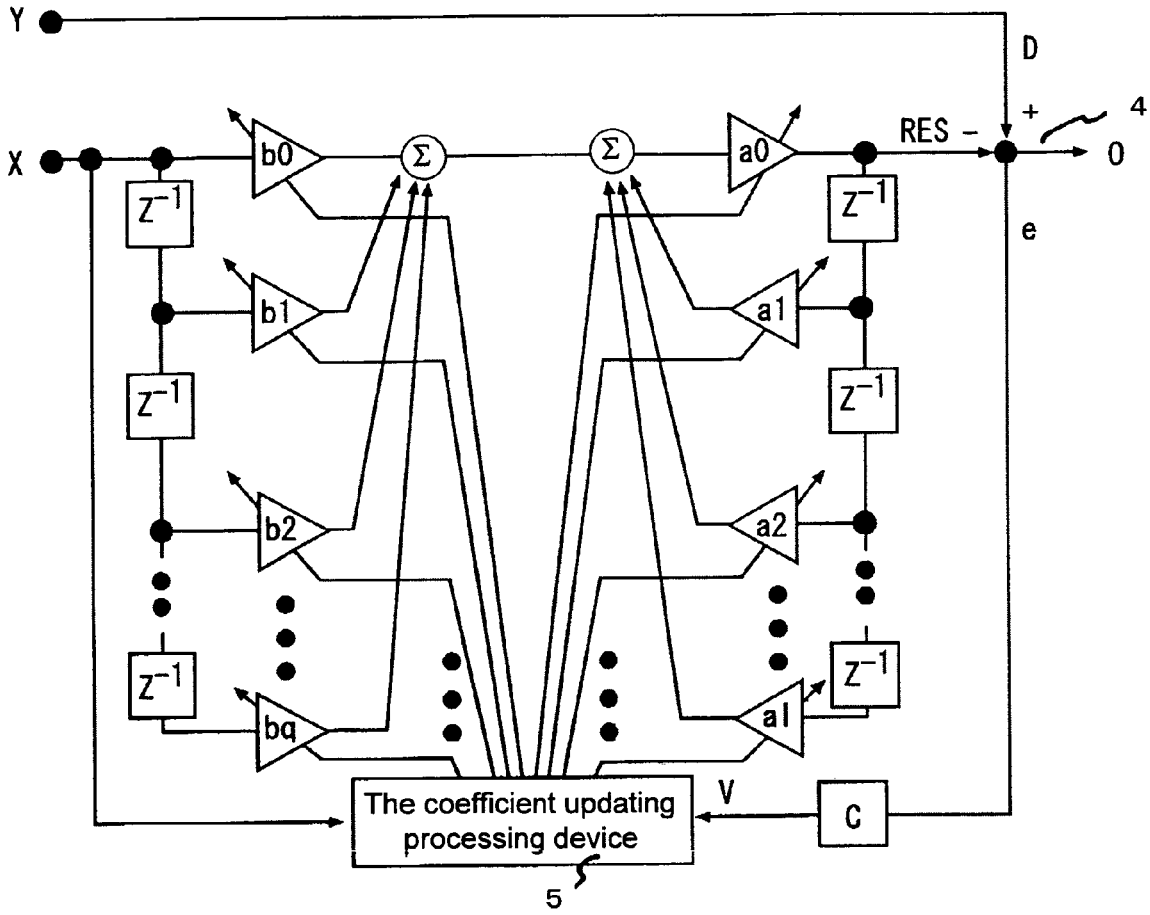
FIG. 7 is a block diagram showing an example of construction of the correlation eliminating device using an IIR filter.

An example of the construction of a correlation eliminating processing device using adaptive signal processing based on an IIR filter is shown in FIG. 7.

In this adaptive correlation eliminating device, a first coefficient processing device a with $a_0, a_1, \ldots, a_1$ as constituent elements, and a second coefficient processing device b with $b_0, b_r, \ldots, b_q$ as constituent elements, are provided, and an input signal X successively subjected to delay processing by means of delay processing devices $Z^{-1}$ provided in multiple stages is input into each stage of these first and second coefficient processing devices a and b.

The signal X that is input into the first and second coefficient processing devices a and b is processed as shown by the following "Equation 11", so that a response signal RES is obtained. Subsequently, in the operator 4, the response signal RES is subtracted from the input signal Y as indicated in "Equation 12" through "Equation 14", so that an error signal e and output signal O are obtained.

$$RES(n)=a_0(n)X(n)+a_1(n)X(n-1)+\ldots a_1(n)X(n-1)+b_0(n)X(n)+b_1X(n-1)+\ldots+b_q(n)X(n-q) \quad \text{Equation (11)}$$

$$D(n)=Y(n) \quad \text{Equation (12)}$$

$$O(n)=D(n)-RES(n) \quad \text{Equation (13)}$$

$$e(n)=O(n) \quad \text{Equation (14)}$$

In this embodiment, the respective coefficient processing devices a and b are updated by the coefficient updating processing device 5 so that components that show a high correlation with Y components among the X components are extracted by the adaptive algorithm. Various types of updating processing can be used in this coefficient updating processing device 5; in the present embodiment, however, the SHARF (simplified hyperstable adaptive recursive filter) algorithm shown in the following "Equation 15" through "Equation 17" is used. The SHARF algorithm is relatively simple, and closely resembles LMS; ordinarily, the algorithm is stabilized by applying a smoothing filter C to the error signal e.

$$a(n+1)=a(n)+,,\cdot RES(n)\cdot V(n)$$

$$b(n+1)=b(n)+,,\cdot X(n)\cdot V(n) \quad \text{Equation (15)}$$

$$a(n)=[a_0(n)a_1(n)a_2(n)\ldots a_q(n)],a_0(n)=1\ b(n)=[b_0(n)b_1(n)b_2(n)\ldots b_q(n)] \quad \text{Equation (16)}$$

$$V(n)=e(n)\cdot C$$

$$\text{where } C=[C_0\ C_1\ C_2\ C_3\ldots C_q],\ C_0=1 \quad \text{Equation (17)}$$

Thus, in the present embodiment, adaptive correlation eliminating processing is performed while repeating an operation in which the coefficients used in the coefficient processing devices a and b are updated by the coefficient updating processing device 5 using an adaptive algorithm such as that described above, and the updated coefficients are superimposed on the input signal X.

Comparison of Input and Output Signals

Thus, in the present invention, when the source signals INL and INR are input into the adaptive correlation eliminating device, signals ASL and ASR that have been subjected to the abovementioned processing are produced. When the output signals in the present invention using this adaptive correlation eliminating device and the output signals in the prior art are compared, the following results are obtained.

Figure 8:
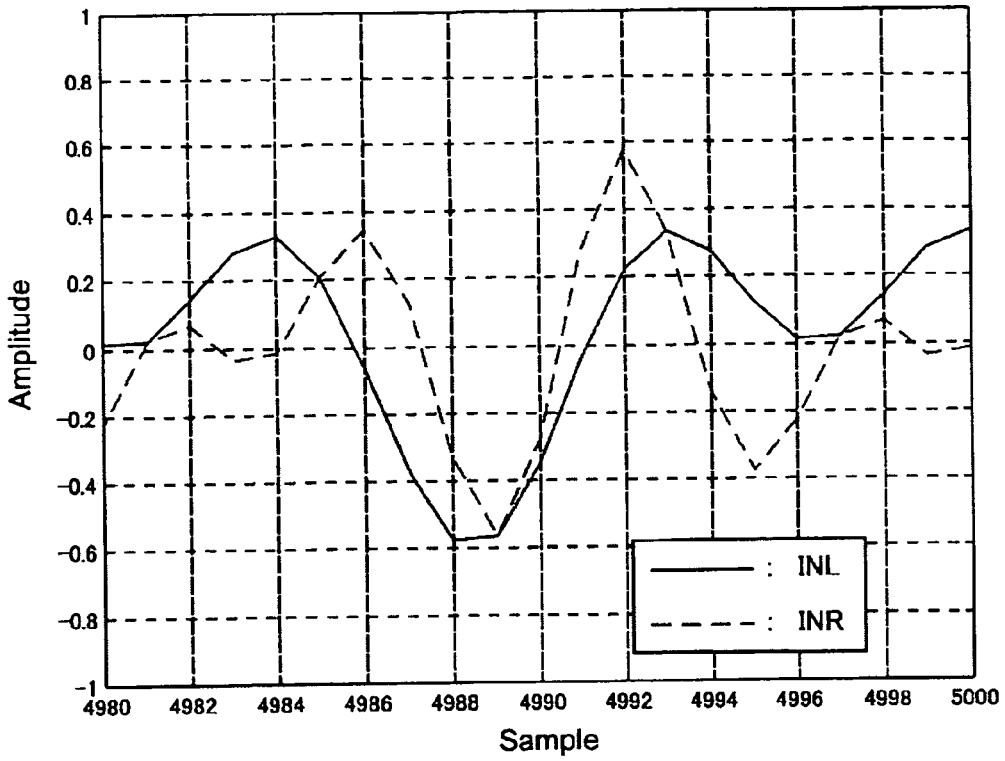
FIG. 8 is a graph showing the waveform of the two-channel stereo signals that are input.
Figure 9:
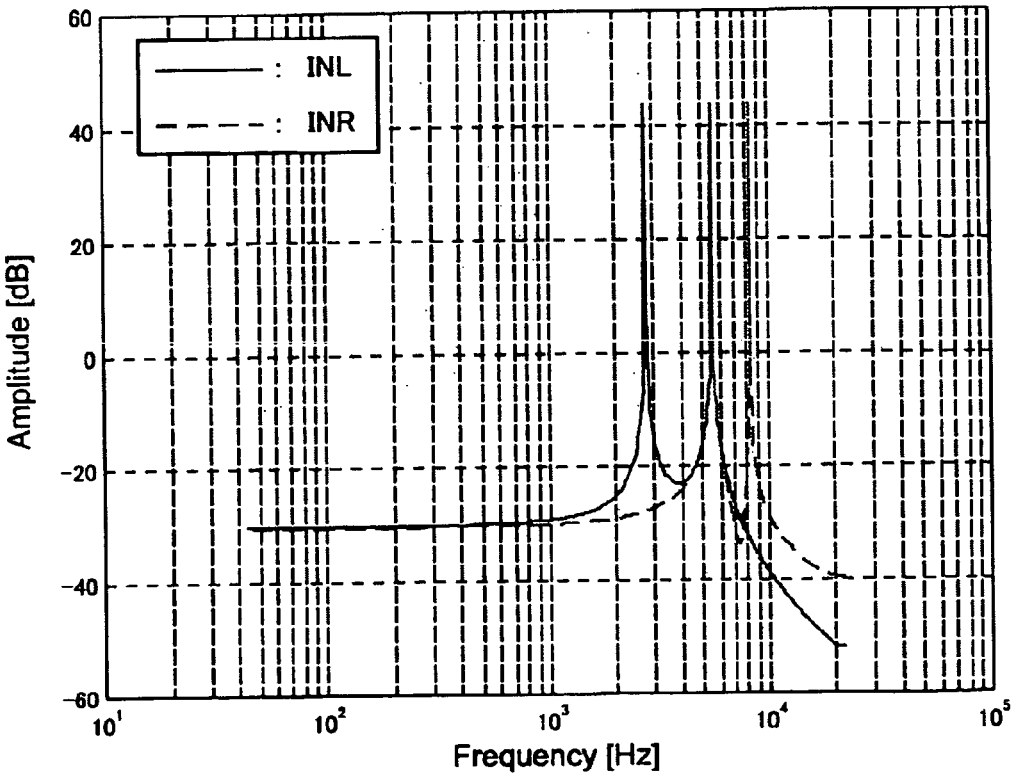
FIG. 9 is a graph showing the frequency characteristics of the two-channel stereo signals that are input.
Figure 10:
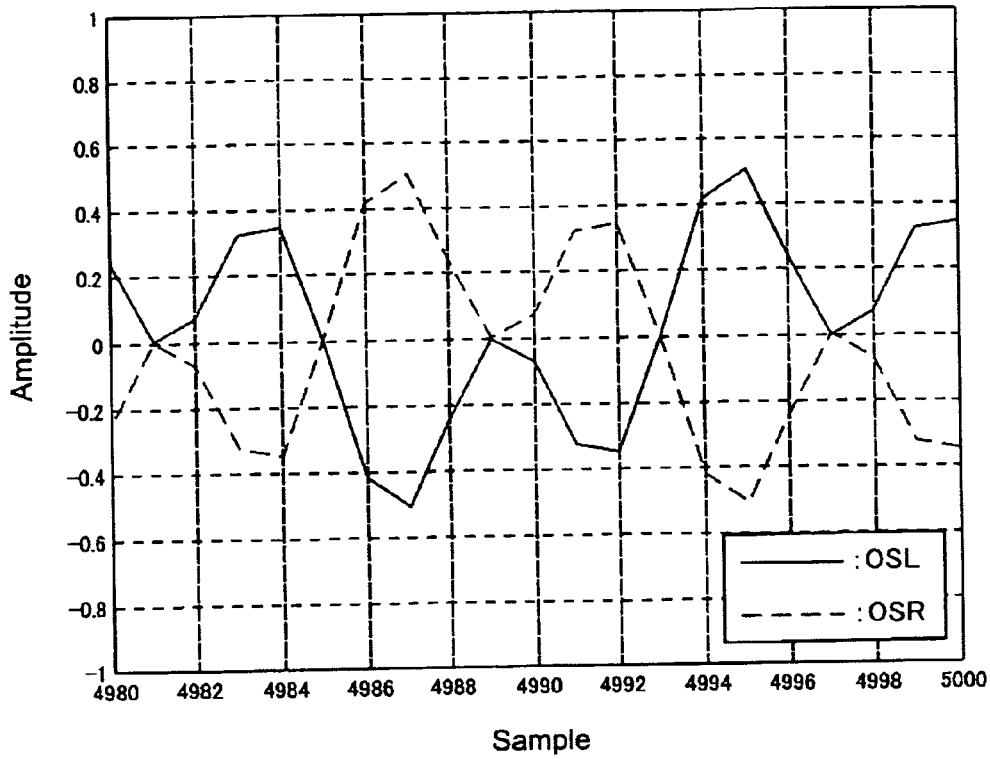
FIG. 10 is a graph showing the waveform of a surround signal produced by a conventional method.
Figure 11:
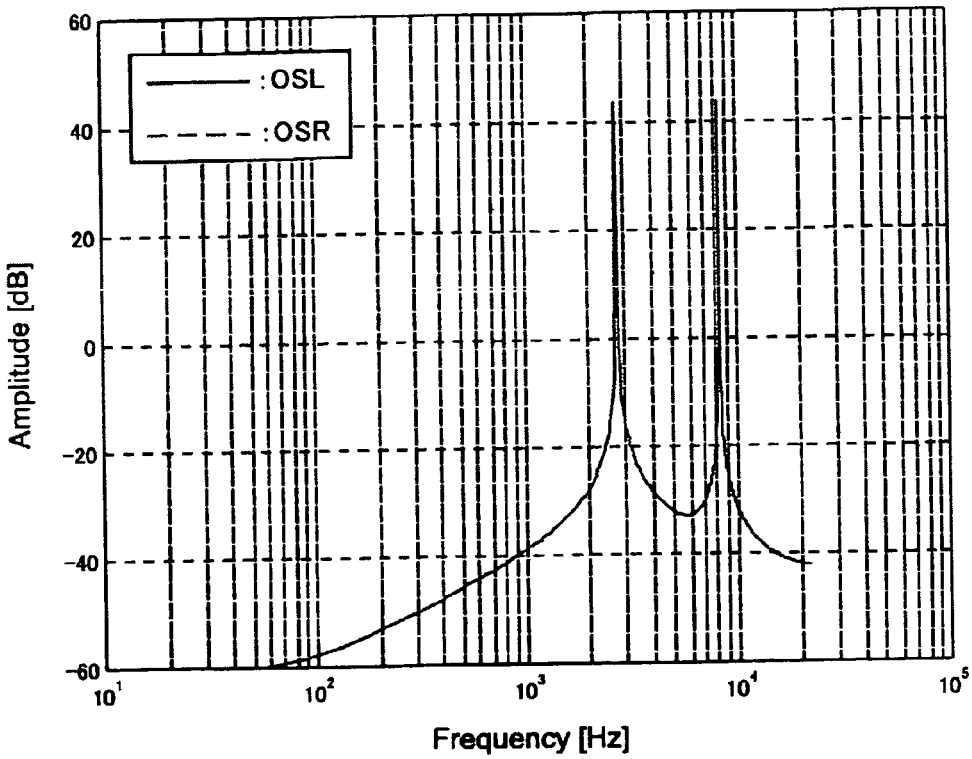
FIG. 11 is a graph showing the frequency characteristics of a surround signal produced by a conventional method.

The source signals INL and INR are shown in FIGS. 8 and 9. These two signals have common signal components in the vicinity of 4.5 kHz. FIGS. 10 and 11 show the signals OSL and OSR produced by a conventional method. It is seen that these output signals OSL and OSR are signals that have the same amplitude but reversed phases, as was described in the prior art section.

Figure 12:
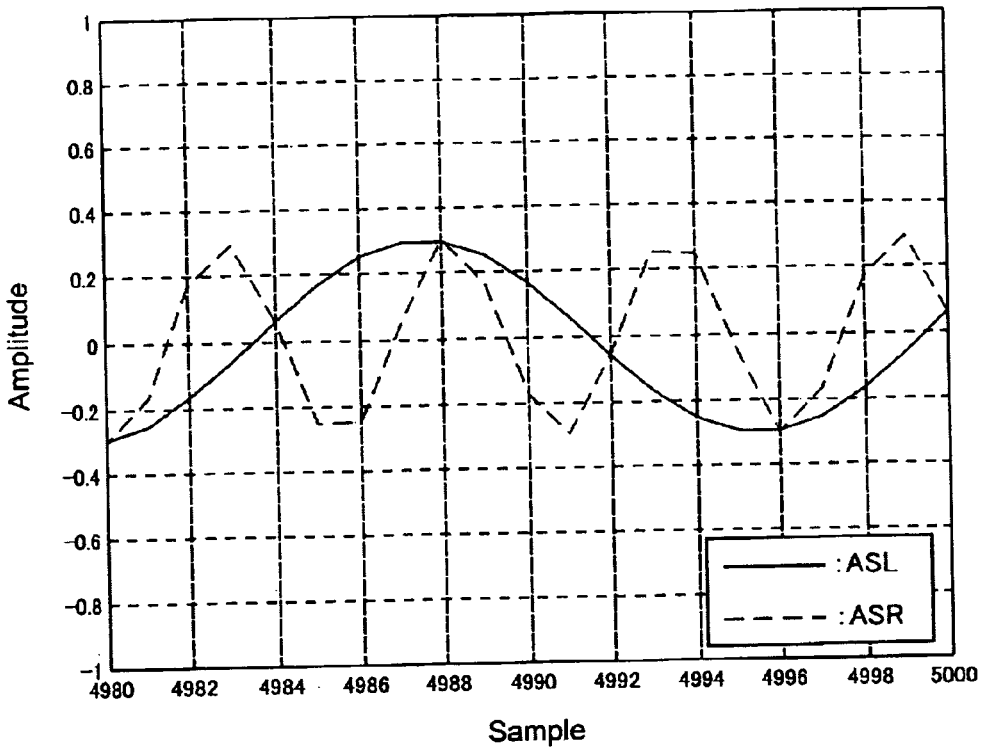
FIG. 12 is a graph showing the waveform of the surround signal produced by the method of the present invention.
Figure 13:
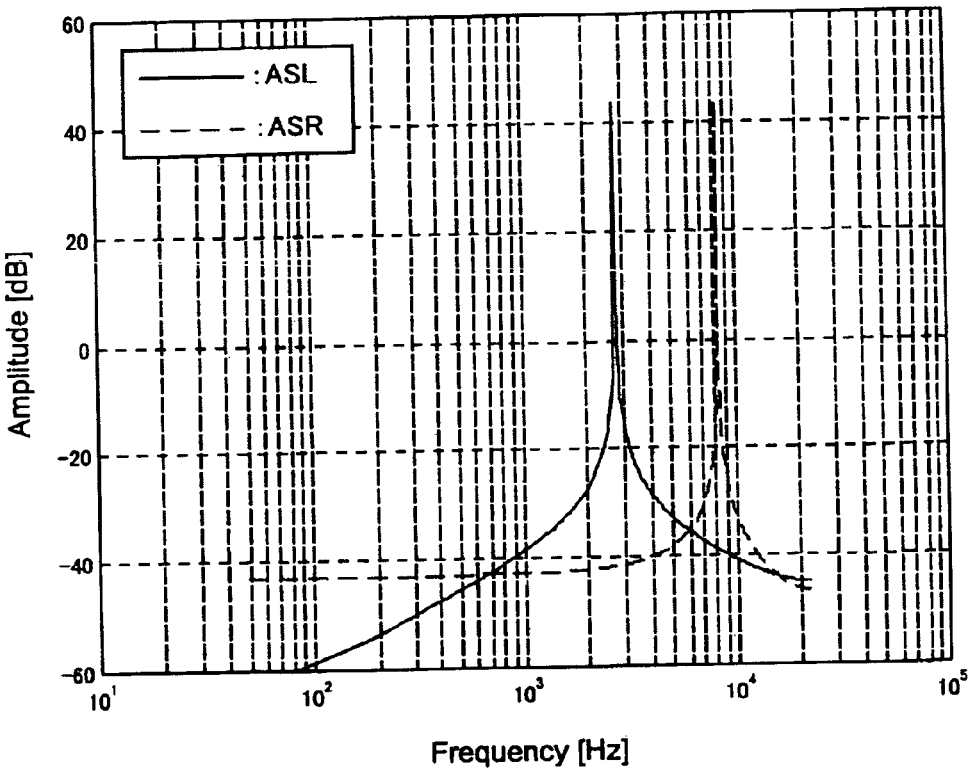
FIG. 13 is a graph showing the frequency characteristics of the surround signal produced by the method of the present invention.

FIGS. 12 and 13 show the surround signals ASL and ASR that are produced by the adaptive correlation eliminating device of the present invention shown in the respective embodiments described above. It can be seen from FIGS. 12 and 13 that the signals are not signals with the same amplitude but reverse phases as in conventional methods, so that signal components that cause the listener to experience a feeling of reversed phases are eliminated. Furthermore, it can be seen that signal components showing a high mutual correlation in the vicinity of 4.5 kHz, which were contained in common in the original signals, are also suppressed by the correlation eliminating processing.

The signals subjected to correlation eliminating processing by the adaptive correlation eliminating device are output in the same manner as other signals as surround signals SL and SR that are band-limited if necessary. In this case, since signals with a high mutual correlation are suppressed in the surround signals SL and SR, the feeling of reversed phases and feeling of disharmony experienced by the listener are eliminated.

INDUSTRIAL APPLICABILITY

In the prior art, as was described above, the experiencing of a feeling of reversed phases and a feeling of disharmony by the listener when surround signals are produced and played back has been a problem. In the present invention, however, since correlation eliminating processing using a mutually adaptive signal processing technique is performed when surround signals are produced, the elimination of a correlation between the signals that are produced can be realized more effectively, so that listening without a feeling of reversed phases or a feeling of disharmony is possible.

The invention claimed is:

1. An audio device which produces surround signals of a plurality of channels on the basis of audio signals of two channels constituting input signals, characterized in that this audio device is provided with:

a correlation eliminating filter whereby the input signal of a first channel is divided by a multi-stage delay processing device, a specified filter coefficient is superimposed by a coefficient processing device for each of the divided multi-stage outputs so that multi-stage output components are produced, and signal components that have a high correlation with the input signal of a second channel are extracted from the input signal components of the first channel by adding these multi-stage output components; and an adaptive correlation eliminating device comprising a coefficient updating processing device which constantly varies the characteristics of the correlation eliminating filter on the basis of error signals obtained by means of the output signals and the input signals from the second channel, the input signals from the first channel, and a step size parameter which controls an updating speed of the specified filter coefficient, and the difference between the output from the correlation eliminating filter and the input signals from the second channel is calculated and output as a surround signal.

2. The audio device according to claim 1, characterized in that the correlation eliminating filter is constructed from an FIR filter.

3. The audio device according to claim 2, characterized in that the coefficient updating processing device performs updating of the coefficients on the basis of an LMS algorithm.

4. The audio device according to claim 1, characterized in that the coefficient updating processing device performs updating of the coefficients on the basis of an NLMS algorithm.

5. The audio device according to claim 1, characterized in that the correlation eliminating filter is constructed from an IIR filter.

6. The audio device according to claim 1, characterized in that the coefficient updating processing device performs updating of the coefficients on the basis of an SHARF algorithm.

7. The audio device of claim 1 further comprising an addition unit adding the input signals from the first channel and the input signals from the second channel and outputting a center signal that is localized in front of or played back in front of a listener.

8. The audio device of claim 7 further comprising a band limiting filter connected to the addition unit, the band limiting filter receiving the center signal and outputting a bass signal.

* * * * *

UNITED STATES PATENT AND TRADEMARK OFFICE

CERTIFICATE OF CORRECTION

PATENT NO. : 7,650,000 B2
APPLICATION NO. : 10/514277
DATED : January 19, 2010
INVENTOR(S) : Kawana et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1136 days.

Signed and Sealed this

Twenty-third Day of November, 2010

David J. Kappos

David J. Kappos
*Director of the United States Patent and Trademark Office*